US005610361A

United States Patent [19]

Vernet et al.

[11] Patent Number: 5,610,361

[45] Date of Patent: Mar. 11, 1997

[54] PRIMER DETONATION DEVICE AND METHOD

[75] Inventors: Robert Vernet, Juillan; Fernand Ortega, Bourges, both of France

[73] Assignee: Giat Industries, Versailles Cedex, France

[21] Appl. No.: 489,166

[22] Filed: Jun. 9, 1995

[30] Foreign Application Priority Data

Jun. 17, 1994 [FR] France ..... 94 07474

[51] Int. Cl.[6] ..... F41A 19/00

[52] U.S. Cl. ..... 89/27.13; 89/27.3; 89/27.14

[58] Field of Search ..... 89/27.13, 27.14, 89/27.3; 42/69.01

[56] References Cited

U.S. PATENT DOCUMENTS 2,245,621 6/1941 Summerbell ..... 89/27
3,951,041 4/1976 Bartolles ..... 89/24
4,207,795 6/1980 Reed et al. ..... 89/1.813
4,301,709 11/1981 Bohorquez et al. ..... 89/11

FOREIGN PATENT DOCUMENTS 2826599 1/1980 Germany .

*Primary Examiner*—J. Woodrow Eldred
*Attorney, Agent, or Firm*—Oliff & Berridge

[57] ABSTRACT

A primer detonation device includes a slide block and a rod. The slide block is configured to slide along an axis within a housing. The housing has a rear end and a front end. The rod is configured to slide within the housing relative to the slide block. A first moving device moves the slide block rearward from a slide block percussion position to a slide block misfire position after a misfire occurs. The first moving device also moves the rod rearward to a rod misfire position. A second moving device moves the slide block forward from the slide block misfire position to a slide block pre-percussion position without moving the rod. The slide block and the rod are locked together in an armed pre-percussion position.

20 Claims, 4 Drawing Sheets

PRIMER DETONATION DEVICE AND METHOD

BACKGROUND OF THE INVENTION

The present invention concerns a device for artillery for detonation by percussion of a primer.

The present invention also concerns an artillery piece having a detonation device according to the first aspect of the invention.

Numerous types of devices for detonation by percussion of a primer are known. In general, a device of this kind has a percussion rod configured to slide axially inside a housing, in the percussion direction toward the front of the housing or in the opposite direction toward the rear thereof; means for causing the rod to move back toward the rear of the housing to its armed position against the action of a counteracting arming spring; means forming a lock, configured to come into engagement with complementary means for locking the rod in its armed position; means for displacing the means forming a lock so as to release the rod; and means for returning the rod to the locked armed position in the event of a misfire.

A device configured for installation on an artillery piece breech having a breechblock that is movable between the flanges of a breech ring is, for example, known. A device of this kind is rearmed by tensioning a spring at the opening of the breechblock after a munition is fired, the breechblock having for example a slider which pushes the percussion rod back to its armed position. The lock which keeps the rod in the armed position is disengaged from the rod by means of an actuator which actuates the lock directly or by means of a pivoting lever, in the case of a normal munition firing actuation.

In the event of a misfire, when the munition has not functioned, the arming spring must be tensioned manually and the lock must be disengaged manually. As a result, these time-consuming and delicate operations must be performed under poor safety conditions with a risk of sudden explosion since the munition is still in the barrel: specifically this involves uncoupling the actuator, hooking a firing lanyard into a rearming ring and passing the lanyard into a pulley to allow remote rearming, and lastly hooking that same lanyard into a hole in the lock or pivoting lever so the lock can be released and detonation can occur.

The object of the present invention is to eliminate the drawbacks of the known devices and propose a detonation device which makes it possible to rearm and perform a detonation in a single movement, performed remotely, with no operation .on the equipment, especially in the case of a misfire.

According to a first aspect of the present invention, the device of the aforesaid type is characterized in that it also has a slide block configured to slide axially inside the housing; that the rod is itself configured to slide axially with respect to the slide block in response to or against the action of the counteracting arming spring which is arranged between the slide block and the rod; that the means forming a lock are mounted on the slide block or on the rod and are configured to lock the rod in the armed position with respect to the slide block; and that the device additionally has return means configured, in the event of a misfire, to bring the slide block and rod toward the rear into respective predetermined misfire positions, and means for displacing the slide block or the rod with respect to one another from said respective predetermined misfire positions so as to return the rod to its locked armed position with respect to the slide block.

The device according to the invention thus makes it possible to avoid all the dangerous and time-consuming operations required with the known device, and to return the rod to the armed position without presenting the slightest risk to the persons operating the artillery piece in question.

According to an advantageous version of the invention, the return means comprise elastic means acting between the housing and the slide block and configured to bring the slide block back into its predetermined misfire position with respect to the housing, and means of the slide block configured to come into engagement with complementary means of the rod in order to bring the rod back into its predetermined misfire position; the means for displacing the slide block or the rod with respect to one another comprise complementary meshing means mounted respectively on the housing and on the slide block or on the rod, configured to displace the slide block toward the front or the rod toward the rear of the housing when those means are actuated, the latter having a pinion mounted rotatably on the housing and in engagement with complementary means mounted on the slide block or on the rod, and the pinion being rotationally integral with a pulley on which is wound a lanyard allowing remote actuation of rotation of the pulley, as well as a retractable stop mounted on the rod or on the slide block and configured to come into engagement with a complementary configuration of the housing to prevent displacement of the rod toward the front or of the slide block toward the rear of the housing upon operation of the means for displacing the slide block or the rod with respect to one another, and complementary means of the slide block and of the rod to retract the retractable stop when the rod has arrived in its armed position with respect to the slide block.

According to a preferred version of the present invention, the means forming a lock are configured to lock the rod in the armed position with respect to the slide block when the rod is in its rear position with respect to the slide block, the pinion is engaged with complementary meshing means provided on the slide block, the misfire position of the slide block is its rear position with respect to the housing, the retractable stop is mounted on the rod; and the winding of the lanyard on the pulley and the arrangement of the pinion and the complementary meshing means of the slide block are such that pulling on the lanyard causes the slide block to be displaced toward the front of the housing.

The lanyard and pulley thus make it possible, after a normal rearming following firing of a munition, to advance the slide block and the rod toward the front of the housing until the means forming a lock disengage to release the percussion rod. In the event of a misfire, the lanyard and pulley make it possible to displace the slide block toward the front of the housing with respect to the rod, which is immobilized by the stop, until the slide block arrives in a position allowing operation of the means forming a lock, which returns the rod to the armed position with respect to the slide block, and to continue forward displacement of the slide block to cause a release of the percussion rod under conditions identical to those of normal operation of the device.

According to a second aspect of the present invention, the artillery piece having a device for detonation by percussion of a primer is characterized in that it has a device according to the first aspect of the invention.

According to a preferred version of the invention, the artillery piece, having a breechblock that is movable between the flanges of a breech ring, is characterized in that the detonation device is fastened to the breech ring; and that the breechblock has means for causing the percussion rod to move back toward the rear of the housing to its armed position when the block moves from its closed-breech position to its open-breech position after a munition has been fired.

Other features and advantages of the present invention will become evident from the detailed description below.

BRIEF DESCRIPTION OF THE DRAWINGS

In the attached drawings, provided only as nonlimiting examples.

DETAILED DESCRIPTION OF PREFERRED EMBODIMENTS

Figure 1:
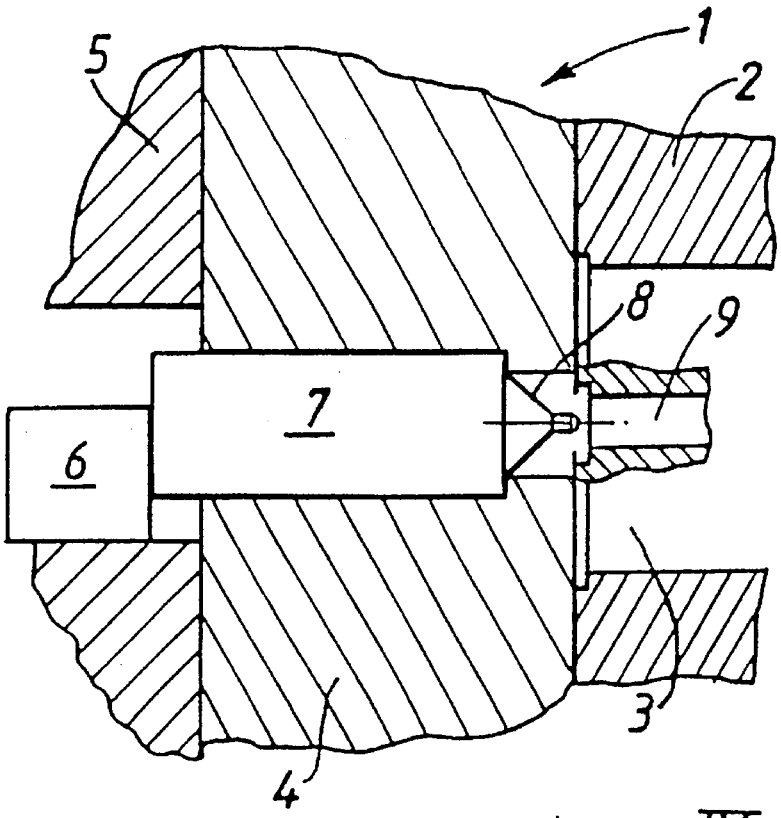
FIG. 1 is a diagram representing, in partial section along a plane passing through the axis of the barrel and parallel to the displacement direction of the breechblock, an embodiment of the breech of an artillery piece according to the second aspect of the present invention, said breech being equipped with a detonation device according to the first aspect of the invention.
Figure 2:
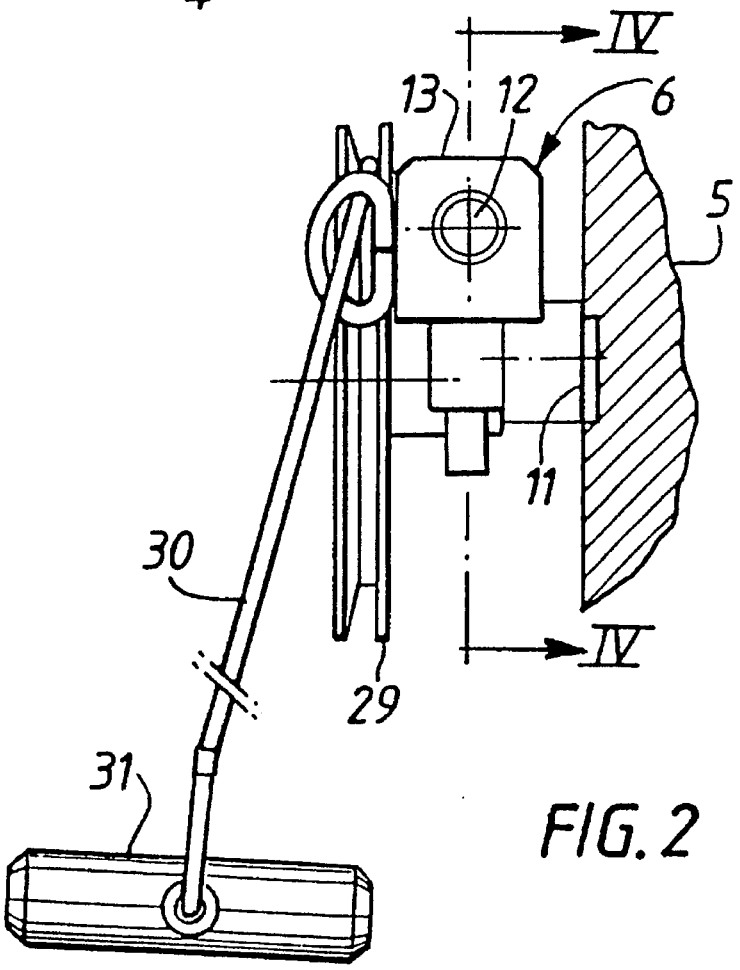
FIG. 2 is a schematic front view of an embodiment of the detonation device according to the first aspect of the present invention, fastened to the breech ring of an artillery piece.

In the schematic depiction of FIG. 1, the artillery piece (not depicted) has a breech (schematically illustrated by reference numeral 1) retaining a barrel 2 inside which a munition 3 is held in position by a breechblock 4, diagrammed in its closed-breech position, which is movable with respect to a breech ring 5 onto which is fastened a detonation device 6. An intermediate device of any known type, which need not be described in detail here and is schematically illustrated at 7, is interposed between detonation device 6 and a firing pin 8 configured to strike a primer 9.

Primer 9 has been depicted as fastened onto rear surface 10 of munition 3 solely for purposes of the drawing. It is understood that intermediate device 7 can be any device using direct transmission or 90-degree offset, and that the invention can be used with all systems for supporting and striking a primer, such that the latter can be separate from munition 3.

In the embodiment depicted in FIGS. 2 to 7, detonation device 6 is fastened onto breech ring 5 in any manner, schematically illustrated by reference numeral 11, for example by means of screws (not depicted).

Device 6 has, in a known manner, a percussion rod 12 configured to slide axially inside a housing 13, in the percussion direction toward the front 14 of housing 13 as diagrammed by arrow 15, or in the opposite direction toward the rear 16 of housing 13; means for causing rod 12 to move back toward the rear 16 of housing 13 to its armed position against the action of a counteracting arming spring 17; means forming a lock 18 configured to come into engagement with complementary means for locking rod 12 in its armed position; means for displacing the means forming a lock 18 so as to release rod 12; and means for returning rod 12 to the locked armed position in the event of a misfire.

FIGS. 2 to 7 were based on the hypothesis that breechblock 4 has means (not depicted) for causing percussion rod 12 to move back toward the rear of housing 13 to its armed position when breechblock 4 is displaced from its closed-breech position, diagrammed in FIG. 1, to its open-breech position after a munition is fired. These means can be, for example, in a known manner, a slider provided on the surface of breechblock 4 and configured so as to cause rod 12 to move back.

According to the invention, detonation device 6 is characterized in that it also has a slide block 19 configured to slide axially inside housing 13; that rod 12 is itself configured to slide axially with respect to slide block 19 in response to or against the action of counteracting arming spring 17 which is placed between slide block 19 and rod 12; that means forming a lock 18 are mounted on slide block 19 or on rod 12 and are configured to lock rod 12 in the armed position with respect to slide block 19; and that device 6 additionally has return means configured, in the event of a misfire, to bring slide block 19 and rod 12 back toward rear 16 of housing 13 into respective predetermined misfire positions, and means for displacing slide block 19 or rod 12 with respect to one another from said respective predetermined misfire positions so as to return rod 12 to its locked armed position with respect to slide block 19.

Figure 4:
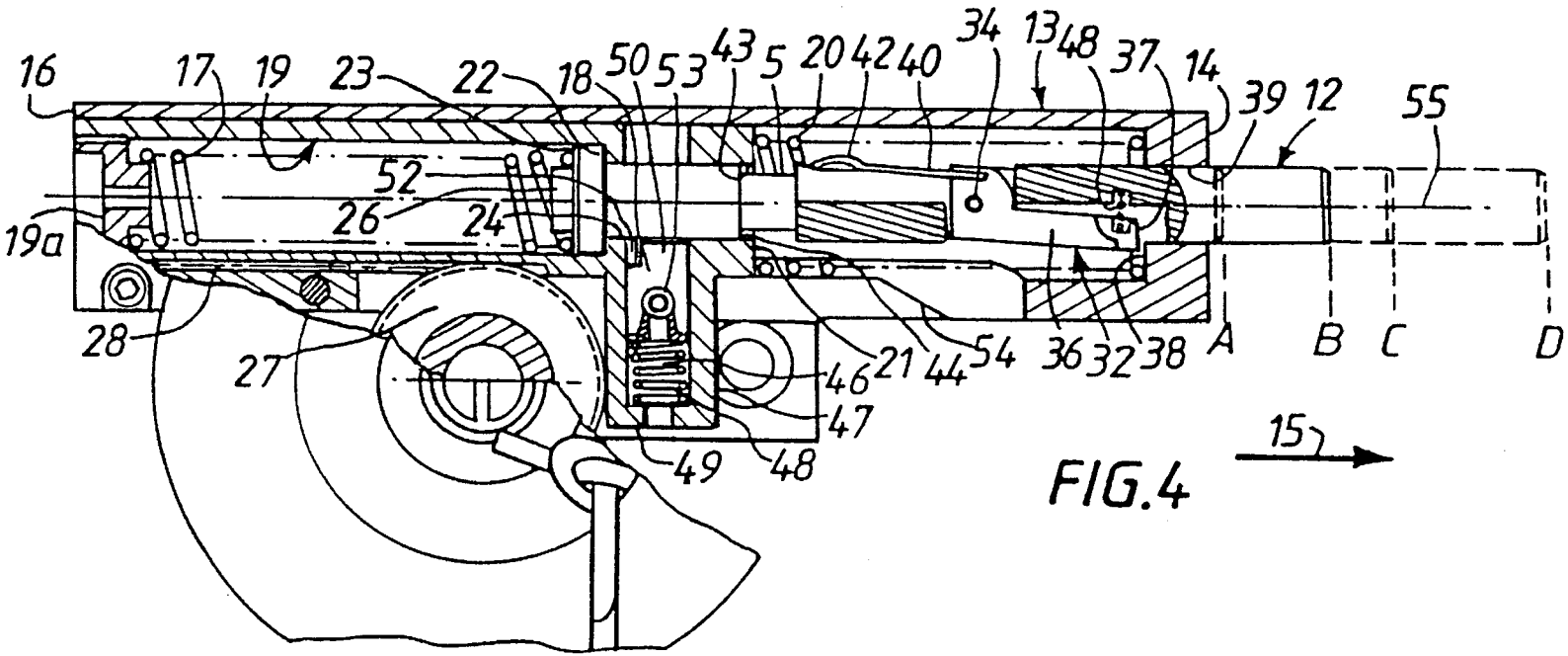
FIG. 4 is a view partly in elevation from the left and partly in section along IV—IV of FIG. 2, the device being depicted in the misfire position.

It is evident from FIGS. 4 to 7 that the return means comprise elastic means 20 acting between housing 13 and slide block 19, and configured to bring slide block 19 back into its predetermined misfire position with respect to housing 13. In the example depicted, these elastic means include a return spring 20 mounted between front 14 of housing 13 and a front surface 21 of slide block 19. The misfire position of slide block 19, depicted in FIG. 4, is identical to the rear position of the latter in the rearmed position of device 6 depicted in FIG. 5, in which rear end **19*a* of slide block 19 is at the level of rear end 16 of housing 13**.

The return means also comprise inwardly projecting means 22 of slide block 19 configured to come into engagement with complementary outwardly projecting means 23 of rod 12 to bring rod 12 back into its predetermined misfire position when return spring 20 brings the slide block back into its predetermined misfire position.

Inwardly projecting means 22 of slide block 19 include edges 22 of an axial opening 24 of the slide block, through which slides a cylindrical part 25 of rod 12. Externally projecting means 23 of rod 12 include a collar 23 projecting outward with respect to cylindrical part 25 in the vicinity of rear end 26 of rod 12.

The means for displacing slide block 19 or rod 12 with respect to one another from their respective predetermined misfire positions comprise complementary meshing means mounted respectively on housing 13 and on slide block 19 or on rod 12, and configured to displace slide block 19 toward front 14, or rod 12 toward rear 16, of housing 13 when said complementary meshing means are operated. This involves a relative movement of one with respect to the other, and the means specific to the slide block, to be described below, could be transferred to the rod.

In the example depicted, the complementary meshing means comprise a pinion 27 mounted rotatably on housing 13 and in engagement with complementary means, for example a rack 28, provided on slide block 19. Pinion 27 is rotationally integral with a pulley 29 on which is wound a lanyard 30 equipped at its free end with a handle 31. By pulling on lanyard 30 with handle 31, it is possible to remotely actuate rotation of pulley 29 and actuate displacement of slide block 19 with respect to housing 13 by means of pinion 27 and rack 28.

The means for displacing slide block 19 or rod 12 with respect to one another also comprise a retractable stop 32 mounted on rod 12 or on slide block 19 and configured to come into engagement with a complementary configuration 38 of housing 13 to prevent displacement of rod 12 toward the front, or of slide block 19 toward the rear, of housing 13 when pulley 29 is operated.

Figure 5:
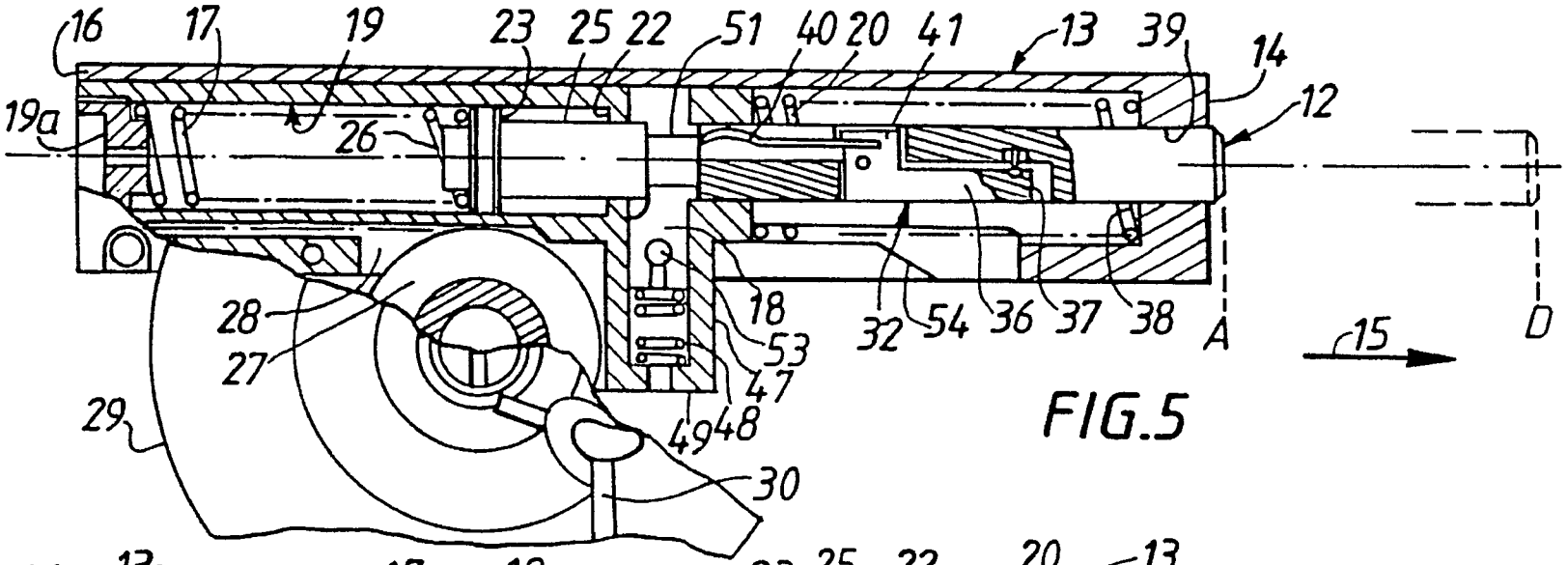
FIG. 5 is a view similar to FIG. 4, the device being depicted in the rearmed position.

In the example depicted, the misfire position of slide block 19 is its rear position with respect to the housing depicted in FIGS. 4 and 5, and retractable stop 32 is mounted on rod 12. Lanyard 30 is wound onto pulley 29, and pinion 27 and rack 28 are arranged in such a way that pulling on lanyard 30 causes slide block 19 to be displaced in the direction of arrow 15 toward front 14 of housing 13.

Figure 3:
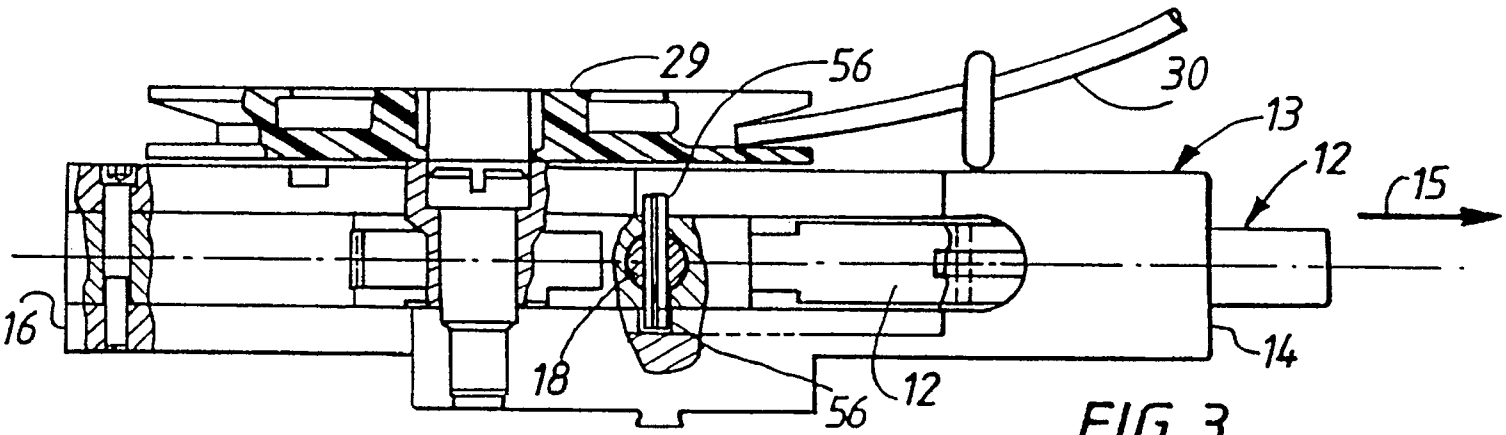
FIG. 3 is a top view, with cutouts, of the detonation device schematically illustrated in FIG. 2.

As depicted in particular in FIGS. 3 and 4, retractable stop 32 is a substantially L-shaped stop mounted pivotably about an axis 34 between two flanges 35 of rod 12. Stop 32 has one axially elongated web whose weight causes stop 32 to pivot about axis 34, clockwise and downward in FIG. 4, when slide block 19 and rod 12 are in their respective predetermined misfire positions depicted in said FIG. 4. Under these conditions, free end 37, located at the front, of web 36 comes to rest against lower edge 38 of opening 39 provided in front end 14 of housing 13 for the passage of rod 12. A spring 58 can also be housed in two seats provided on the respective facing surfaces of rod 12 and of stop 32, to facilitate the movement of stop 32 into its stop position.

A lever 40 is fastened to radially extending web 41 of stop 32 on the other side of axis 34 with respect to axially elongated web 36. Lever 40 is configured to come into engagement, at its rounded free end 42, with upper edge 43 of axial opening 44 provided in front surface 21 of slide block 19 for the passage of rod 12. In this position, depicted in FIGS. 6 and 7, lever 40 is received in recess 45 provided in the body of rod 12 and causes stop 32 to pivot, counterclockwise in FIG. 4, about axis 34 so that web 36 can pass freely into opening 39.

Figure 6:
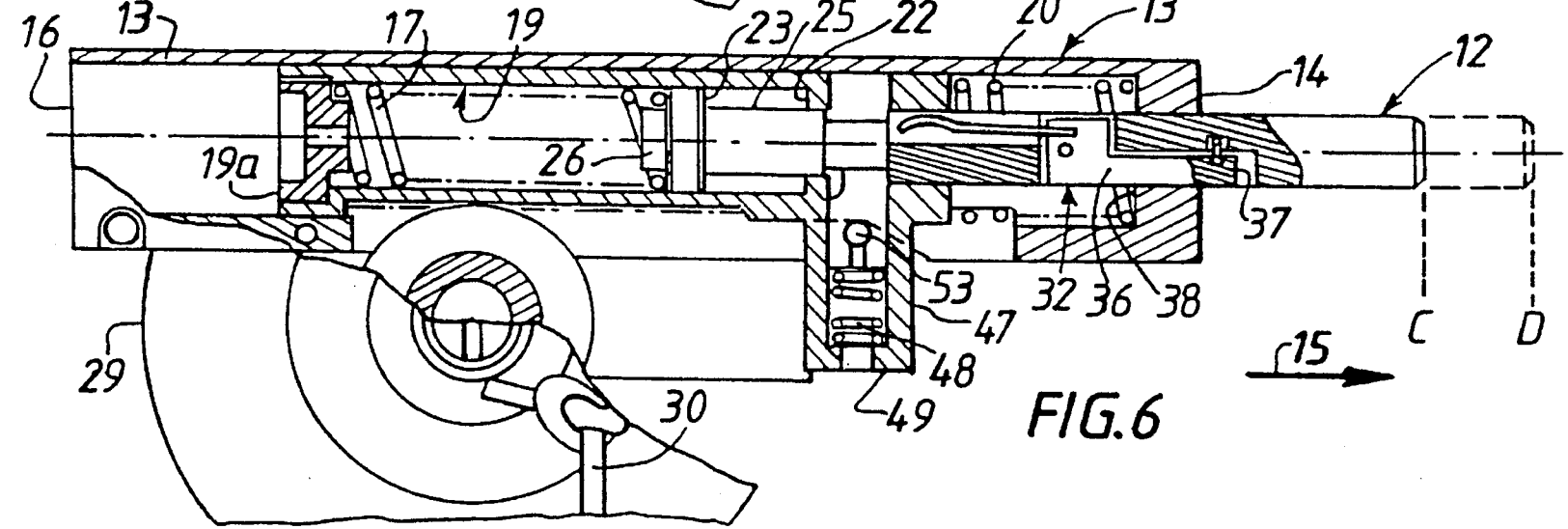
FIG. 6 is a view similar to FIG. 4, the device being depicted in the pre-percussion position.

Means forming a lock 18 are configured to lock rod 12 in the armed position with respect to slide block 19 when rod 12 is in its rear position with respect to slide block 19, as depicted in FIGS. 5 and 6.

In this example, lock 18 is a member, depicted in FIG. 3 as having a cylindrical section, which is displaced radially in a receptacle 46 provided in a radial protuberance 47 of slide block 19. Lock 18 is continuously pushed in the direction of rod 12 by a spring 48 pressing on base 49 of protuberance 47. Inside end 50 of lock 18 is configured to come into engagement with a cylindrical constriction 51 of rod 12 provided in front of cylindrical part 25 thereof. The rear corner of end 50 is cut away at 52 to allow the axial clearance between slide block 19 and rod 12 needed, in the armed position, for lever 40 to lift stop 32.

As depicted in FIGS. 3 to 7, the means for displacing lock 18 in order to release rod 12 have both the means described above—pinion 27 and rack 28—for displacing slide block 19 with respect to housing 13 toward the front 14 thereof, and complementary means located respectively on lock 18 and on housing 13 in positions predetermined so as to displace lock 18 and release rod 12 when slide block 19 and rod 12 are in respective positions, depicted in FIG. 6, located toward the front of housing 13 with respect to their corresponding respective misfire positions depicted in FIG. 4.

It is evident, especially from FIGS. 3 and 4, that the means located on lock 18 include, for example, of a pin 53 passing through lock 18 and outer walls of protuberance 47 and projecting laterally on either side of said walls. The complementary means located on housing 13 comprise two ramps 54 sloping toward front 14 of the housing and downward in FIG. 4, i.e. in the direction away from the rod, with respect to axis 55 that is common to rod 12, housing 13, and slide block 19.

Thus when slide block 19 and rod 12, locked thereto, are in their forward pre-percussion position depicted in FIG. 6, ends 56 and 57 of pin 53 are ready to come into engagement with ramps 54 to move lock 18 away from the rod as slide block 19 continues to advance toward front 14 of the housing, so as to release the rod and cause percussion of the primer.

A description will now be given, with reference to FIGS. 3 to 7, of the operation of the detonation device according to the invention. After successful firing of a munition, the device is once again in the rearmed position depicted in FIG. 5. Slide block 19 has been brought back into its rear position by return spring 20 and by the rearward movement of rod 12 caused by the movement of the breechblock. Lock 18 is engaged in constriction 51 of rod 12. Lever 40 keeps stop 32 in the retracted position.

Figure 7:
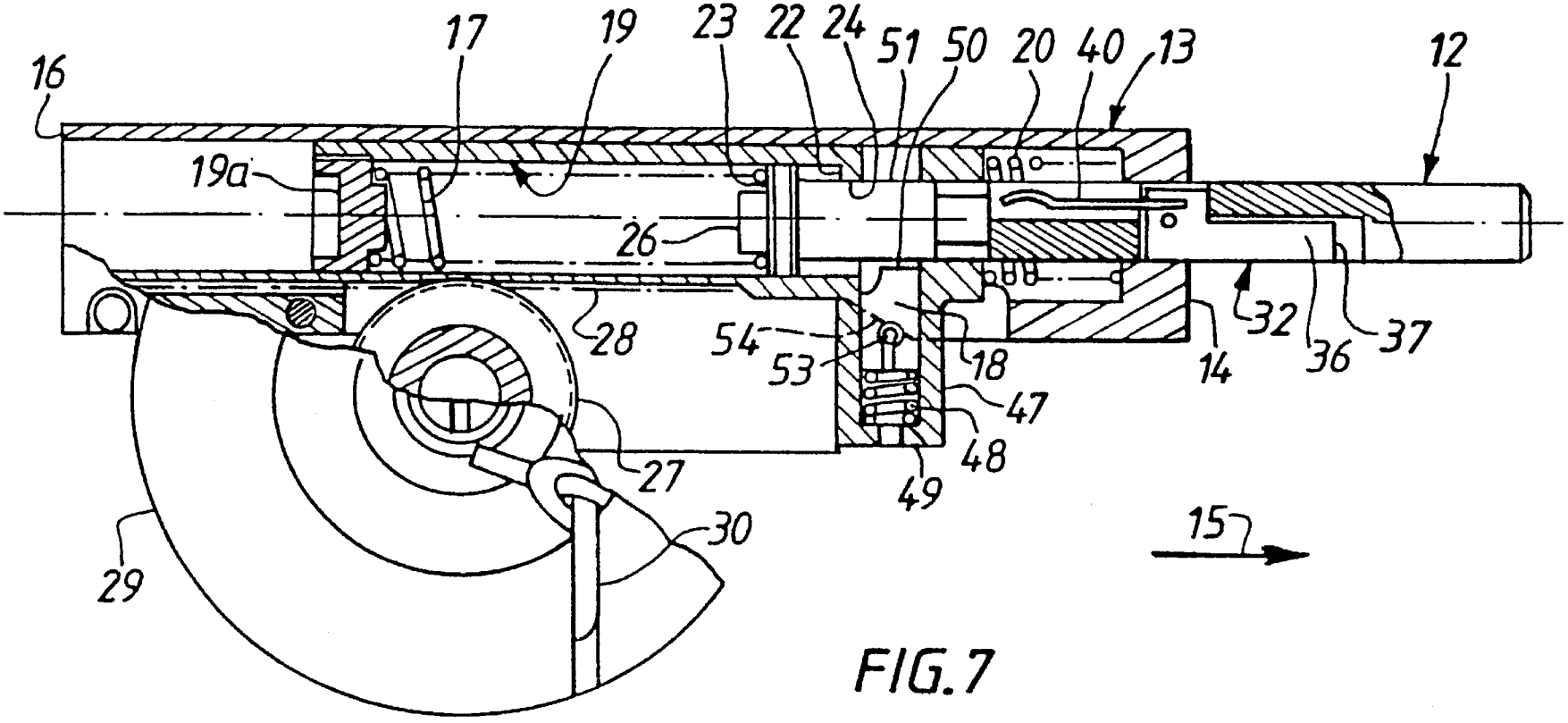
FIG. 7 is a view similar to FIG. 4, the device being depicted in the post-percussion position before rearming.

To actuate firing of the munition, lanyard 30 is pulled to cause pulley 29 to turn and cause slide block 19 and rod 12 to advance forward to the pre-percussion position of FIG. 6 and then to the post-percussion position of FIG. 7. In this latter position, slide block 19 is in its extreme forward position, and has not yet been sent backward again by return spring 20. Rod 12 is also in its forward percussion position, with stop 32 retracted, and has not yet been brought backward by the movement of the breechblock.

In the event of a misfire, return spring 20 pushes slide block 19 back from its forward position of FIG. 7 to its rear position of FIG. 4. Edge 22 of axial opening 24 of slide block 19 has come into engagement with collar 23 of rod 12 to bring the latter back into its misfire position of FIG. 4. Under these conditions, stop 32 drops under its own weight and comes into engagement with lower edge 38 of opening 39 in front 14 of housing 13.

When lanyard 30 is pulled to cause pulley 29 and pinion 27 to turn, slide block 19 is caused to advance forward with respect to rod 12, which is immobilized by stop 32, until lock 18 comes into engagement with constriction 51. The device is then in a rearmed position after a misfire. If slide block 19 is caused to advance even farther forward, upper edge 43 of opening 44 forces lever 40 to drop and to lift stop 32 up to its retracted position, which allows continued forward displacement of slide block 19 and rod 12 into the armed and locked position with respect thereto. This forward movement continues up to the pre-percussion position of FIG. 6 and up to the percussion position of FIG. 7, in a manner identical to a normal detonation.

The four successive principal positions of percussion rod 12 with respect to the housing have therefore been indicated on FIG. 4 and FIGS. 5 to 7: position A (rearmed and locked after a normal firing) depicted in FIG. 5; position B (misfire, stop 32 active) depicted in FIG. 4; position C (armed, pre-percussion) depicted in FIG. 6; and position D (post-percussion and before rearming) depicted in FIG. 7.

Of course the invention is not limited to the embodiment that has just been described, and numerous changes and modifications can be made thereto without leaving the context of the invention.

For example, the means of the invention for rearming the device after a misfire can be associated with a conventional detonation device. It is also possible to replace lanyard 30 and pulley 29 with equivalent means for actuating both normal detonation after a normal firing, and rearming and detonation after a misfire.

The shape and structure of numerous components of the device according to the invention can also be replaced by other equivalent shapes and structures which allow the same result to be achieved.

What is claimed is:

1. A method of rearming a primer detonation device after a misfire occurs, the primer detonation device having a slide block, a rod that actuates a firing pin and a housing that slidingly receives the slide block and the rod, the method comprising:

a first step of moving the slide block from a slide block percussion position rearward to a slide block misfire position after the misfire occurs, thereby moving the rod to a rod misfire position; and a second step of moving the slide block forward and locking the slide block to the rod without moving the rod relative to the housing.

2. The method of claim 1, wherein the second step of moving includes continuing to move the locked slide block and rod to a prepercussion position.

3. The method of claim 1, wherein the second step of moving includes pulling a lanyard to move the slide block.

4. The method of claim 1, wherein the locking includes engaging a lock attached to the slide block with the rod to secure the slide block and rod together.

5. The method of claim 4, wherein the locking includes retracting a rod stop such that the rod becomes free to move with the slide block.

6. A primer detonation device for an artillery piece, comprising:

a slide block configured to slide along an axis within a housing, the housing having a rear end and a front end;

a rod configured to slide within the housing, the rod being slidable relative to the slide block against an action of an arming spring disposed between the rod and the housing;

a first moving device that moves the slide block rearward from a slide block percussion position to a slide block misfire position after a misfire occurs, the first moving device thereby moving the rod rearward to a rod misfire position; and a second moving device that moves the slide block forward from the slide block misfire position to a slide block pre-percussion position without moving the rod relative to the housing; and a lock that locks the slide block and the rod together such that the rod and the slide block are movable together from the slide block pre-percussion position.

7. The device of claim 6, wherein the first moving device includes a resilient member disposed between the slide block and the housing to urge the slide block into a slide block misfire position.

8. The device of claim 6, wherein the first moving device includes a first engaging member attached to the slide block and a second engaging member attached to the rod, and wherein the first engaging member is disposed to engage the second engaging member when the slide block returns to the slide block misfire position such that the slide block and the rod return to the respective slide block and rod misfire positions together.

9. The device of claim 8, wherein the rod is shaped to slide within the slide block, the first engaging member includes at least one projection attached to the slide block and the second engaging member includes a collar attached to the rod and shaped to engage the at least one projection.

10. The device of claim 6, wherein the second moving device includes a first driving member attached to the housing and a second driving member attached to the slide block, and wherein actuating the first driving member engages the second driving member such that the slide block moves relative to the housing.

11. The device of claim 10, wherein the first driving member includes a pinion and the second driving member includes a corresponding rack portion, and wherein the pinion is rotatable to engage the rack portion.

12. The device of claim 10, further comprising a stop and a stop receiving portion, and wherein when the second driving member moves the slide block relative to the rod, the stop engages the stop receiving portion to prevent the rod from moving relative to the housing.

13. The device of claim 12, wherein the slide block includes a first stop retracting portion and the rod includes a second stop retracting portion, and wherein the first stop retracting portion is engageable with the second stop retracting portion to retract the stop when the lock locks the rod and the slide block together.

14. The device of claim 6, wherein the lock is attached to the slide block and engageable with a constricted portion of the rod.

15. The device of claim 6, further comprising a lock release having a first releasing element attached to the slide block and a second releasing element attached to the housing, wherein the first releasing element is engageable with the second releasing element when the rod and the slide block are in a position forward of the respective misfire positions of the rod and slide block to release the lock.

16. The device of claim 15, wherein the first releasing element includes a cam surface and the second releasing element includes a cam follower engageable with the cam surface.

17. The device of claim 6, wherein at least one of the first and second moving devices is actuable by pulling a lanyard.

18. The device of claim 6, wherein the primer detonation device is attached to a breech ring of the artillery piece, the artillery piece having a breechblock that moves between an open position adjacent a first flange of the breech ring and a closed position adjacent a second flange of the breech ring, and wherein the breechblock moves the rod rearward to an armed position when the breechblock moves from the closed position to the open position after a munition is fired.

19. A primer detonation device configured for rearming after a misfire occurs, the primer detonation device having a slide block, a rod that actuates a firing pin and a housing that slidingly receives the slide block and the rod, and further comprising:

means for moving the slide block from a slide block percussion position rearward to a slide block misfire position after the misfire occurs, thereby moving the rod to a rod misfire position; and means for moving the slide block forward and locking the slide block to the rod without moving the rod.

20. An artillery piece comprising the primer detonation device of claim 6.

* * * * *